United States Patent [19]

Kobayashi et al.

[11] Patent Number: 4,721,703

[45] Date of Patent: Jan. 26, 1988

[54] SUBLIMATION TRANSFER SYSTEM COLOR HARD COPY PRINTING PAPER

[75] Inventors: Naotake Kobayashi; Tetsuya Abe; Yoshio Fujiwara, all of Utsunomiya, Japan

[73] Assignee: Sony Corporation, Tokyo, Japan

[21] Appl. No.: 589,090

[22] PCT Filed: Jun. 6, 1983

[86] PCT No.: PCT/JP83/00184

§ 371 Date: Feb. 7, 1984

§ 102(e) Date: Feb. 7, 1984

[87] PCT Pub. No.: WO83/04395

PCT Pub. Date: Dec. 22, 1983

[30] Foreign Application Priority Data

Jun. 7, 1982 [JP] Japan ..... 57-97346

[51] Int. Cl.[4] ..... B41M 5/26

[52] U.S. Cl. ..... 503/227; 8/471; 428/195; 428/537.5; 428/913; 428/914; 428/413; 428/475.5; 428/479.6; 428/481; 428/535; 428/536

[58] Field of Search ..... 430/281, 285, 201, 941; 428/413, 475.5, 479.6, 481, 535, 536, 195, 537.5, 913, 914; 282/27.5; 8/471; 503/227

[56] References Cited

U.S. PATENT DOCUMENTS

| | | | |
|---|---|---|---|
| Re. 28,789 | 4/1976 | Chang | 430/281 |
| 3,708,305 | 1/1973 | Koyanagi et al. | 430/281 |
| 4,091,122 | 5/1978 | Davis et al. | 427/44 |
| 4,097,230 | 6/1978 | Sandhu | 8/471 |
| 4,117,198 | 9/1978 | Power et al. | 428/482 |
| 4,237,185 | 12/1980 | Lombardi et al. | 430/285 |
| 4,288,479 | 9/1981 | Brack | 428/352 |
| 4,316,952 | 2/1982 | Wendling | 430/285 |
| 4,388,387 | 6/1983 | Tsuboi | 430/201 |
| 4,505,975 | 3/1985 | Majima | 428/511 |

FOREIGN PATENT DOCUMENTS

| | | |
|---|---|---|
| 47-46207 | 11/1972 | Japan . |
| 50-96215 | 7/1975 | Japan . |
| 55-39378 | 3/1980 | Japan . |
| 55-39379 | 3/1980 | Japan . |

*Primary Examiner*—Won H. Louie

*Attorney, Agent, or Firm*—Hill, Van Santen, Steadman & Simpson

[57] ABSTRACT

The present invention relates to a sublimation transfer system color hard copy printing paper particularly to prevent effectively the printing paper from being adhered by melt with a dye carrier ribbon when a color hard copying is carried out, transfer dye satisfactorily and present excellent color. To this end, the sublimation transfer system color hard copy printing paper of the present invention has formed, on the surface of a base material, a layer formed of thermo-plastic resin having a transferring property relative to a dispersing dye and a compound having two or more radically polymerizable unsaturated double bonds in one molecule and the sublimation dye is transferred on this resin layer to thereby present color.

6 Claims, No Drawings

SUBLIMATION TRANSFER SYSTEM COLOR HARD COPY PRINTING PAPER

TECHNICAL FIELD

The present invention relates to a printing paper suitable for color copying by the sublimation transfer of sublimation dye.

BACKGROUND ART

It is possible that an ink made by dispersing or dissolving a sublimation dye into a resinous liquid is coated and dried on a paper to form a dye carrier ribbon, this dye carrier ribbon is heated on its back surface by a thermal print head to sublimate the dye contained in the ink, and the dye then is transferred to a suitably surface treated printing paper which is suitably to be superposed to the dye carrier paper, whereby a color copy can be obtained. In this case, since in general a temperature of the thermal print head reaches 200° C. or above, a resin in the dye carrier ribbon (hereinafter referred to as a binder) and a resin which is coated in the surface treating layer of the printing paper are both softened by heat and then adhered to each other by melt. To avoid this, the binder and the coating resin are cross-linked so as to have a heat resisting property. This, however, could not achieve satisfactory effect.

As the resin used in a coating composition which is coated on the surface of the printing paper, there is used a thermo-plastic resin, for example, saturated linear polyester resin, epoxy resin and the like which can excellently adsorb and diffuse a sublimation dye.

Since these resins are melted or softened inherently by heat generated from a thermal print head and the sublimated dye is effectively transferred and diffused on that portion so as to be colored, these resins are apt to be adhered by melt with the binder contained in the dye carrier ribbon. To solve this problem, it has been done to improve the heat resisting property of the coating resin by cross-linking made by addition reaction using isocyanate group and the like, or cross-linking made by condensation reaction using melamine resin or the like. This could not provide a satisfactory heat resisting property so that the adherence by melt could not be avoided. On the other hand, a coating layer having excellent heat resisting property was provided by the cross-linking using the amine-series curing agent of epoxy resin. This coating layer could not be prevented from being adhered by melt with the dye carrier ribbon.

DISCLOSURE OF INVENTION

The present invention relates to a printing paper which can solve these problems and which can not only keep effective transferring and coloring property of the sublimation dye but also prevent the dye carrier ribbon from being adhered by melt with the printing paper perfectly.

Namely, the present invention relates to a printing paper made by coating and hardening on the surface of a paper a coating composition which contains a resin adsorbing a sublimation dye excellently and a compound partially substituting the resin which compound having more than two radically polymerizable unsaturated double bonds in one molecule. Without lowering the coloring property by the transfer of the sublimation dye, the sublimation transfer system color copying printing paper of the present invention can effectively prevent the dye carrier ribbon from being adhered by melt therewith so that the dye can be transferred sufficiently with satisfactory coloring property.

More in detail, the sublimation transfer system color hard copying printing paper of the present invention is formed such that a composition material consisting of 20 to 98 parts by weight of thermo-plastic resin having a transferring property to a dispersing dye and 80 to 2 parts by weight of a compound having more than 2 radically polymerizable unsaturated double bonds in one molecule is formed on the surface of a base material and this composition material is cross-linked.

BEST MODE FOR CARRYING OUT THE INVENTION

It is considered that a coating resin used in the present invention can effectively achieve a satisfactory cross-linking to thereby improve the heat resisting property, without losing satisfactory transferring property of a thermo-plastic resin suitable for the transfer of the sublimation dye by the reaction of unsaturated group and as a result, the coating resin can prevent the adherence from being caused by melt.

As the thermo-plastic resin with transferring property for the dispersing dye which can be used in the present invention, there are saturated linear polyester-series resin, epoxy-series resin, cellulose acetate-series resin, nylon-series resin and the like.

The compound usable in this invention and having two or more unsaturated groups in one molecule, are by way of example, multifunctional monomer represented by, for example, diarylphthalate, trimethylolpropane tri-(meta-) acrylate, trimethylolethane tri-(meta-) acrylate, tetramethylolmethane tri-(meta-) acrylate, 1, 6-hexanediol di-(meta) acrylate and the like; multifunctional epoxy acrylate represented by bisphenol A type epoxy acrylate, novolak type epoxy acrylate, alkyleneglycoldiepoxy acrylate, epoxy acrylate bromide, glycidylester acrylate and the like; multifunctional unsaturated polyester which is provided by reacting unsaturated dicarboxylic acid such as fumaric acid, maleic acid, itaconic acid or the like with terminal groups of reaction product of a saturated dicarboxylic acid such as orthophthal acid, isophthal acid, telephthal acid, adipic acid, sebacic acid and so on with polyol such as ethyleneglycol, propyleneglycol, bisphenol A and so on; polybutadiene represented by 1, 2-polybutadiene, denatured polybutadiene having acryl group or ester group as its terminal group, multifunctional polyether acrylate represented by ethyleneglycol di-(meta-) acrylate, diethyleneglycol di-(meta-) acrylate, polyethyleneglycol di-(meta-) acrylate, 1, 3-butyleneglycol di-(meta-) acrylate, neopentylglycol di-(meta-) acrylate or the like; and polyester acrylate represented by a reaction product of adipic acid and 1, 6 -hexanediol terminated with acryl groups or the like.

In order to react the unsaturated groups, peroxide such as benzoylperoxide, hydroperoxide or the like may be dissolved into the coating composition as a radical initiator. Alternatively, in order to accelerate the reaction, a metal soap such as naphthenic acid cobalt, and a tertially amine family such as dimethylaniline, dimethylparatholidyne or the like may be used as an accelerator. Moreover, it may be possible that a sensitizer such as benzoinethylether, benzophenone or the like are added and ultraviolet rays are irradiated to perform the cross-linking. Furthermore, even if radiant rays such as electron rays, X-rays and the like are employed to carry out the cross-linking, the same object can be attained, so means for such purpose is not restricted particularly.

If the amount of the compound having the unsaturated group contained in the coating composition is less than 2 weight %, the cross-linking is not sufficient so that the dye carrier ribbon is adhered by melt with the printing paper. Also, if it exceeds 80 weight %, the adherence by melt does not occur but the resin layer to which the dye can be transferred is too reduced to present the satisfactory coloring property.

Moreover, it is desired that the molecular weight of the compound which contains two or more radically polymerizable unsaturated group in one molecule is selected in a range from 100 to 10,000. If the molecular weight is less than 100, the resin becomes too hard, while if it exceeds 10,000, the adherence preventing effect between the dye carrier ribbon and the printing paper upon thermal transferring is lost.

If necessary, to the coating composition of the present invention may be mixed at maximum 50 weight % of inorganic particles, for example, silica, calcium carbonate, Kaolin clay, barium sulfate, titanium oxide or the like. When the inorganic particles are added to the coating composition, there can be achieved such effects that the surface of the printing paper is made uniform, the whiteness index thereof is raised, the coloring property is increased and the adherence by melt becomes difficult to be caused, etc. However, if the inorganic particles of more than 50 weight % are added thereto, the particles be apt to be dropped upon printing and the coloring property is caused to be scattered.

Further, in order to increase the whiteness index, it is possible to add a phosphor whitener dye, for example, 4, 4'-bis (4, 6-di-substituted)-1, 3, 5-triazynyl-disulphonic acid-series compound, $\alpha$, $\beta$-bis (benzoxycazoryl) ethylene-series compound, alcoxy naphthalenic acid-N-substituted imide-series compound and the like.

In this case, 0.01 to 5.0 parts by weight of the phosphor whitener dye can be added to 100 parts by weight of resin.

When the phosphor whitener dye of the above mixing ratio is mixed into a coating composition (hereinafter referred to as the resinous liquid of the present invention) made of the above thermo-plastic resin and the above compound, coated and then dried on the surface of the base material, it is possible to obtain the printing paper which presents the satisfactory transferring and coloring property.

Moreover, it is possible that, as means for increasing the effect of the present invention, the resinous liquid (which does not contain the compound having two or more radically polymerizable unsaturated double bonds in one molecule) containing inorganic particles of relatively high concentration is coated and dried on the surface of the base material as a first layer and after that, the abpve resinous liquid of present invention is coated thereon as a second layer or the composition in which the above phosphor whitener dye is mixed into this resinous liquid is coated thereon and then dried, thus providing the printing paper being free from the adherence by melt and which can present the high transferring and coloring property.

As means for further increasing the effect of the present invention, it is possible that the resinous liquid of the present invention is coated and dried on the surface of the base material as the first layer and then a composition in which the phosphor whitener dye is mixed into this resinous liquid is coated thereon as the second layer, or a composition in which the above phosphor whitener dye is mixed into the resinous liquid of the present invention is coated and dried thereon as the first layer and then, the resinous liquid of the present invention is coated and dried thereon as the second layer and thus the printing paper which is free from the adherence by melt and which presents higher transferring and coloring property can be obtained.

It may be possible that a part of the resin which can sufficiently transfer the sublimation dye used in the resinous liquid of the present invention is substituted with a resin having no transferring property of dye to an extent that the coloring property is not affected. Also, even when a part of the afore-mentioned multifunctional monomer and oligomer is substituted with monofunctional monomer and oligomer to an extent that no adherence is caused by melt, the characteristic of the present invention is never lost.

Furthermore, it is possible to add an activated metal compound such as aluminium chelate compound, organic acid magnesium salt and the like which can vary the coloring of the dye.

Even in a case of multi-color printing wherein particularly the primary color ribbons are pressed on the printing paper several times to thereby be apt to easily cause the adherence by melt, according to the use of the printing paper of the present invention, it is possible to obtain a color print which is free from the adherence by melt and which has high transferring and coloring property of sublimation dye.

The present invention will hereinafter be described with reference to examples.

COMPARATIVE EXAMPLE 1

An ink consisting of 6 parts by weight of a dispersing dye (PTR 63 manufactured by MITSUBISHI CHEMICAL INDUSTRIES CO., LTD.) having sublimation property, 6 parts by weight of ethyl cellulose and 88 parts by weight of isopropyl alcohol solvent was coated on a paer of area weight of 40 g /m$^2$ by a gravure coater with a coating amount of 5 g /m$^2$ when dried, thus a dye carrier ribbon having a transferring property being made. On the other hand, a coating composition consisting of 21.5 parts by weight of saturated linear polyester resin (VILON #200 manufactured by TOYOBO CO., LTD.), 10 parts by weight of isocianate curing agent (Colonate L manufactured by NIPPON POLYURETHANE INDUSTRIAL CO., LTD.), 7.5 parts by weight of ultra fine silica powder (NIPSIL E220A manufactured by NIPPON SILICA INDUSTRIAL CO., LTD.) and 70 parts by weight of methylethyl ketone solvent was coated on one surface of a best quality paper having an area weight of 170 g/m$^2$ heated and cured for one day at 60° C. to produce a sublimation transfer system color copying printing paper which had the dried coating amount of about 5 g/m$^2$. Then, by using the thermal print head set at a temperature of approximately 300° C., the dye carrier paper was heated from its back surface at every 20 msec. to sublimate the dye on the surface of the above printing paper to form a picture to be printed. Thereafter, when the dye carrier paper and the printing paper which were bonded together were released from each other, although the satisfactory dyeing was carried out by the dye, most of the printed portion was adhered by melt and they could not be released from each other so that the dye carrier paper was torn.

COMPARATIVE EXAMPLE 2

A coating composition made of 21.5 parts by weight of solid epoxy resin (EPICOAT 1009 manufactured by SHELL KAGAKU KABUSHIKI KAISHA), 1.0 parts by weight of melamine resin (SUPERBECKAMINE manufactured by DAINIPPON INK & CHEMICALS INC.), 7.5 parts by weight of ultra fine silica powder (NIPSIL E220A manufactured by NIPPON SILICA INDUSTRIAL CO., LTD.) and 70 parts by weight of methylethyl ketone solvent was coated at 120° C., dried and hardened for 10 minutes with a coating amount of approximately 5 g/m$^2$ when dried. Thus, the printing paper was formed. This printing paper was printed under the same condition as that in the comparative example 1. After the printing, although the dye carrier paper and the printing paper were released from each other, the adherence by melt occurred so that the dye carrier paper was torn.

COMPARATIVE EXAMPLE 3

A coating composition made of 22 parts by weight of solid epoxy resin, 0.5 parts by weight of undecylimidazole (manufactured by SHIKOKU CHEMICALS CORPORATION), 7.5 parts by weight of ultra fine silica powder (NIPSIL E220A manufactured by NIPPON SILICA INDUSTRIAL CO., LTD.) and 70 parts by weight of methylethyl ketone solvent was coated and cured at 120° C. for 5 minutes, followed by curing at 60° C. for one day. After that, the printing paper thus made was printed under the same condition as that in the comparative example 1. Although the dye carrier paper was released from the printing paper, the adherence by melt occurred, so it could not released from the printing paper.

EXAMPLE 1

A coating composition made of 14.9 parts by weight of saturated polyester resin (STAFIX L-PC manufactured by FUJI PHOTO FILM CO., LTD.), 8.9 parts by weight of compound having two or more radically polymerizable unsaturated double bonds in one molecule, for example, unsaturated polyester (U'PICA 8524 manufactured by JAPAN U'PICA CO., LTD.), 0.2 parts by weight of ketone peroxide (PERHEXA H, manufactured by NIPPON OILS & FATS CO., LTD.), 0.002 parts by weight of naphthenic acid cobalt (manufactured by WAKO PURE CHEMICAL INDUSTRIES LTD.), 6.0 parts by weight of ultra fine silica powder and 70 parts by weight of mixed solvent of toluene and methylethyl ketone was coated, dried and hardened at 120° C. for 5 minutes with a dried coating amount of 5 g/m$^2$. Thus, a printing paper was formed. This printing paper was printed under the same condition as that in the comparative example 1. After that, when the dye carrier paper and the printing paper were released from each other, they were released satisfactorily, causing no adherence by melt therebetween at all. The transferring and coloring of the dye was excellent.

EXAMPLE 2

A coating composition made of 20.4 parts by weight of saturated polyester resin (STAFIX L-PC manufactured by FUJI PHOTO FILM CO., LTD.), 0.6 parts by weight of trimethylpropane triacrylate (A-TMPT manufactured by SHINNAKAMURA CHEMICAL CO., LTD.), 0.03 parts by weight of ketone peroxide (PERHEXA H) (manufactured by NIPPON OILS & FATS CO., LTD.), 0.001 parts by weight of naphthenic acid cobalt, 9 parts by weight of ultra fine silica powder (NIPSIL E220A manufactured by NIPPON SILICA INDUSTRIAL CO., LTD.) and 70 parts by weight of mixed solvent of toluene and methylethyl ketone was coated, dried and cured at 120° C. for 5 minutes. Thus, a printing paper was obtained. When this printing paper was subjected to the similar printing experiment to that in the comparative example 1, a color print having excellent color of dye and which is perfectly free from the adherence by melt was obtained.

EXAMPLE 3

A coating composition made of 4 parts by weight of epoxy resin, 4 parts by weight of saturated polyester resin, 15.8 parts by weight of compound having two or more radically polymerizable unsaturated double bonds in one molecule, for example, unsaturated polyester (U'PICA 8524 manufactured by JAPAN U'PICA CO., LTD.), 0.5 parts by weight of ultraviolet ray curing initiator (Irgacure 651 manufactured by CIBA-GEIGY A.G.), 6 parts by weight of ultra fine silica powder and 70 parts by weight of methylethyl ketone was coated and dried with a coating amount of 5 g/m$^2$ when dried. After that, it was irradiated with an ultraviolet ray in the nitrogen atmosphere and thus cured and a printing paper was made. This printing paper was printed under the same condition as that in the comparative example 1. After printing, a color print having excellent color of dye and which is free from the adherence by melt was obtained.

EXAMPLE 4

A coating composition made of 15.7 parts by weight of saturated polyester resin (VILON #200 manufactured by TOYOBO CO., LTD.), 6.8 parts by weight of compound having two or more radically polymerizable unsaturated double bonds in one molecule, for example, epoxy acrylate (SP 4010 manufactured by SHOWA HIGHPOLYMER CO., LTD.), 5.5 parts by weight of ultra fine silica powder (NIPSIL E220A), 2 parts by weight of titanium oxide (SR-1 manufactured by SAKAI CHEMICAL INDUSTRY CO., LTD.) and 70 parts by weight of methylethyl ketone was coated with a coating amount of approximately 5 g/m$^2$ when dried. After that, this coating was irradiated with electron beam of 7 mega-rad by an electron beam irradiating apparatus (CBIJO/15/10L type manufactured by ENERGY SCIENCE INC.), which then was cured and thus a printing paper was made. This printing paper was printed under the same condition as that in the comparative example 1. The adherence was not caused by melt between the printing paper and the dye carrier paper and the dye was transferred satisfactorily so that a color print of excellent color was obtained.

EXAMPLE 5

A coating composition made of 15 parts by weight of saturated polyester resin (VILON #200 manufactured by TOYOBO CO., LTD.), 15 parts by weight of ultra fine silica powder, 0.7 parts by weight of isocianate compound (Colonate L manufactured by NIPPON POLYURETHANE INDUSTRIAL CO., LTD.) and 70 parts by weight of methylethyl ketone solvent was coated with a coating amount of approximately 5 g/m$^2$ when dried, thus forming a first layer. This first layer was heated at 60° C. for one day and cured on which the coating composition made by the example 1 was coated, dried and cured at 120° C. for 5 minutes so as to form a second layer which has a coating amount of approximately 3 g/m$^2$ when dried. The printing paper thus made was printed under the same condition as that in the comparative example 1. After that, the adherence by melt with the dye carrier paper and the coloring property of dye were observed. As a result, no adherence was caused by melt and the quite excellent color was presented.

We claim:

1. A printing paper for use in a sublimation transfer system hard copy in which a dye carrier ribbon having a dye having sublimation property upon heating and a printing paper are put in contact with each other, and selectively heated to transfer said dye to said printing paper to make a hard copy on said printing paper, said printing paper comprising a base material and a coating formed on said base material receiving said dye, said coating consisting essentially of 20 to 98 parts by weight of thermoplastic resin having a dyeing property relative to said dye and being selected from the group consisting of a saturated linear polyester resin, an epoxy resin, a cellulose acetate resin, and a nylon resin, and 80 to 2 parts by weight of a compound having two or more free radical polymerizable ethylenically unsaturated double bonds in one molecule, and said coating being cross-linked, said coating being substantially non-heat bondable to said ribbon by virtue of the cross-linked polymer present therein.

2. A printing paper for use in a sublimation transfer system hard copy according to claim 1, in which the molecular weight of said compound is in a range from 100 to 10,000.

3. A printing paper for use in a sublimation transfer system hard copy according to claim 1, in which said coating further comprises peroxide as a curing agent and then is cured.

4. A printing paper for use in a sublimation transfer system hard copy according to claim 1, in which the curing of said coating is achieved by radiation energy.

5. A printing paper for use in a sublimation transfer system hard copy according to claim 1, in which said coating contains white inorganic powder of less than 50 parts by weight relative to 100 parts by weight of its resin amount.

6. A printing paper for use in a sublimation transfer system hard copy according to claim 1, in which said coating contains 0.01 to 50 parts by weight of phosphor whitener relative to 100 parts by weight of its resin amount.

* * * * *